US008297006B2

(12) United States Patent
Watson

(10) Patent No.: US 8,297,006 B2
(45) Date of Patent: Oct. 30, 2012

(54) FOUNDATIONAL CISTERN

(76) Inventor: Timothy L. Watson, Hillsborough, NC (US)

( * ) Notice: Subject to any disclaimer, the term of this patent is extended or adjusted under 35 U.S.C. 154(b) by 288 days.

(21) Appl. No.: 12/468,572

(22) Filed: May 19, 2009

(65) Prior Publication Data

US 2009/0282754 A1 Nov. 19, 2009

Related U.S. Application Data

(60) Provisional application No. 61/054,179, filed on May 19, 2008.

(51) Int. Cl.
*E02D 29/12* (2006.01)
*E02D 27/00* (2006.01)

(52) U.S. Cl. ..... 52/169.7; 52/20; 52/192

(58) Field of Classification Search ..... 52/20, 192, 52/169.7, 169.6
See application file for complete search history.

(56) References Cited

U.S. PATENT DOCUMENTS

| | | | | |
|---|---|---|---|---|
| 88,272 | A * | 3/1869 | Bush | 52/20 |
| 2,324,878 | A * | 7/1943 | Richmond | 210/286 |
| 2,993,600 | A * | 7/1961 | Ressler | 210/164 |
| 5,862,633 | A * | 1/1999 | Van Ells | 52/16 |
| 6,076,320 | A * | 6/2000 | Butler | 52/294 |
| 6,718,712 | B1 * | 4/2004 | Heath | 52/309.12 |
| 7,721,491 | B2 * | 5/2010 | Appel | 52/169.7 |
| 2008/0127601 | A1 * | 6/2008 | Schiffmann et al. | 52/741.1 |

FOREIGN PATENT DOCUMENTS

| | | | |
|---|---|---|---|
| CH | 701001 | A2 * | 11/2010 |
| DE | 19543766 | A1 * | 5/1997 |
| DE | 20207819 | U1 * | 11/2002 |
| JP | 09041435 | A * | 2/1997 |

* cited by examiner

*Primary Examiner* — Branon Painter
*Assistant Examiner* — Elizabeth A Plummer

(57) ABSTRACT

The present invention is a foundational cistern. The present invention is an evolutionary panelized foundation system that uses known pre-casting technologies, functions structurally in similar ways to traditional systems, yet provides building designers with a multitude of new benefits in combination with the objectives of reduced construction time, energy, and water conservation. Stored rainwater in the cistern provides thermal mass for heating for a supported structure, and may be used for nonpotable uses. Given appropriate on-site water treatment, potable uses of stored rainwater may be contemplated as well. The foundational cistern of the present invention may be coupled to other foundational cisterns and structural elements of the supported structure. The present invention offers a multitude of advantages not currently known in the art of foundation products.

18 Claims, 10 Drawing Sheets

FOUNDATIONAL CISTERN

This application claims the benefit of U.S. Provisional Application No. 61/054,179 filed May 19, 2008.

BACKGROUND

Buildings consume roughly 36% of America's energy production and 12% of its potable water. Innovative building foundation designs are needed to significantly reduce this profile if we are to meet forthcoming water conservation and carbon dioxide emission standards. Use of pre-cast concrete for the construction of building foundations has been underway for over fifteen years, thereby establishing a precedent for use of off-site fabricated concrete panels used primarily for residential basement construction. At the same time, increased awareness about the environment has brought water conservation to the forefront, resulting in consumers who desire to create buildings that are ecologically sensitive, efficient, and economical. Cisterns have been used for many years as a means of containing rainwater and other liquids for long-term storage needs.

There is a need for innovation in the field of foundation design that addresses significant reduction in time required to construct building foundations, reduction of energy consumption, and enhanced water conservation. Presently no apparatus accounts for and addresses all of these combined concerns.

SUMMARY OF THE INVENTION

The present invention is a foundational cistern. The present invention is an evolutionary panelized foundation system that uses known pre-casting technologies, functions structurally in similar ways to traditional systems, yet provides building designers with a multitude of new benefits in combination with the above objectives of reduced construction time, energy, and water conservation. The present invention utilizes specific combinations of pre-cast septic tank based design and pre-cast wall systems, resulting in a foundation system that forms sealed crawl spaces, virtually eliminates the need for ducted air transfer through the application of open air plenum technology, and stores large amounts of rainwater collected from the roof of the structure. The current design of the present invention will provide approximately 7,000 gallons of stored water per approximately 1,000 square feet of single story dwellings, and approximately 3,500 gallons for two story buildings, or structures of similar area. The stored rainwater in the cistern provides thermal mass for heating the structure, and may be used for nonpotable uses such as irrigation, gardening, cleaning outdoor items, and the like. Moreover, it is contemplated that through the use of appropriate on-site water treatment, potable uses for stored rainwater in the foundational cistern is feasible. The present invention offers a multitude of advantages not currently known in the art of foundation products.

In one aspect, the present invention offers a significant reduction of energy consumption needed to heat buildings by moderating insulated sealed crawl space temperature variations. The present invention is compatible with earth sheltering finished grade designs, which augment steady state temperatures within the present invention's sealed crawl space design. The foundational cistern of the present invention augments controlled building mass thermal inputs by harvesting steady state temperature variations within soils averaging 55 degrees Fahrenheit beneath buildings. When properly used, this produces lowered heating loads for occupied space immediately above such foundations.

In one aspect, the present invention may be designed for construction of insulated sealed crawl spaces thereby saving heating operational utility expenditures for the life of the structure.

In another aspect, foundation cistern of the present invention also results in a reduction of detailed site excavation and building foundation construction time by about a factor of 10 (estimated installation time is one to two days in lieu of up to a range of ten to twenty days), thereby potentially lowering equivalent building foundation construction labor costs by up to 20% and minimizing exposure to weather related construction delays.

In yet another aspect, present invention also provides a complete structural foundation system for one or two story residential and light commercial buildings of up to two stories, having brick or stone veneer and which can bear normal roof loads having spans of up to approximately 40 feet under certain circumstances (e.g., type IV and V building loads in accordance with international, State of North Carolina, and local building code requirements).

In one aspect, the foundation cistern of the present invention provides low cost rainwater storage which can be recycled for on-site "non-potable" uses such as landscape irrigation, storm water mitigation, as well as serve as an earth coupled thermal transfer medium for heating and indirect cooling of inhabited areas. As stated above, with treatment, water may be potable. The present invention provides sealed storage of collected rainwater beneath the exterior building perimeter. Increased exposure to water vapor is avoided through the incorporation of separate air vent connections for each cistern. In contrast, prefabricated water containment systems are placed outside of building foundation perimeters costing about $0.50 more per stored gallon. The present invention avoids such costs because no further excavation is needed other than those normally associated with conventional foundation construction.

In another aspect, foundational cistern of the present invention eliminates use of poured-in-place concrete and masonry construction. This allows for the elimination of separate poured-in-place footings along with their specialized excavations, as well as time consuming, labor intensive, hand laid concrete block (CMU) typically used for continuous foundation perimeter walls.

In another aspect, the present invention provides an ideal extraction medium for the control and elimination of radon gas through use of a continuous gravel foundation medium.

In one aspect, the present invention is compatible with open plenum air distribution without exposure to high humidity normally associated with conventional practice (when properly installed and maintained).

In yet another aspect, the present invention may be designed for use in conjunction with either spray applied or rigid insulation board products intended for installation around the panelized building foundation perimeter.

In one aspect, the present invention may be sized to be compatible with either panelized or modular building components, which typically involve significantly less "embodied energy" relative to conventionally framed building construction.

In another aspect, the foundational cistern of the present invention may utilize local and readily available pre-cast septic tank industry resources, which are presently available throughout all United States jurisdictions.

In yet another aspect, the present invention addresses LEED (Leadership in Energy and Environmental Design) certification credits 556.1; 556.2; WE 3.1; and WE 3.2.

These and other benefits can be utilized by existing structures through a combination of retrofitted building load bearing pre-cast concrete cisterns, new building pre-cast concrete cisterns, and building load bearing pre-cast concrete walls. Given complete structural interface of these products, foundation building systems for both new buildings and building additions using the present invention is feasible and capable of providing builders, architects, and structural engineers with an alternative means of transferring building loads to bearing soil while taking advantage of the benefits indicated above.

Such advantages attained through the use of the foundation cistern of the present invention are vast. There are some circumstances where the present invention would not be applicable, such as: locations not exposed to rainfall, some structures requiring full height basement construction throughout their foundation perimeters, construction sites having soils types or inappropriate excavation characteristics or bearing building loads, and commercial buildings producing static and live loads in excess of approximately 2,700 pounds per lineal foot of foundation wall perimeter.

These and other features, aspects and advantages of the present invention will become better understood with reference to the following drawings, description and claims.

BRIEF DESCRIPTION OF THE DRAWINGS

The foregoing aspects and many of the accompanying advantages of this invention will become more readily appreciated as the same becomes understood by reference to the following detailed description, when taken in conjunction with the accompanying drawings, wherein.

DETAILED DESCRIPTION

Figure 1A:
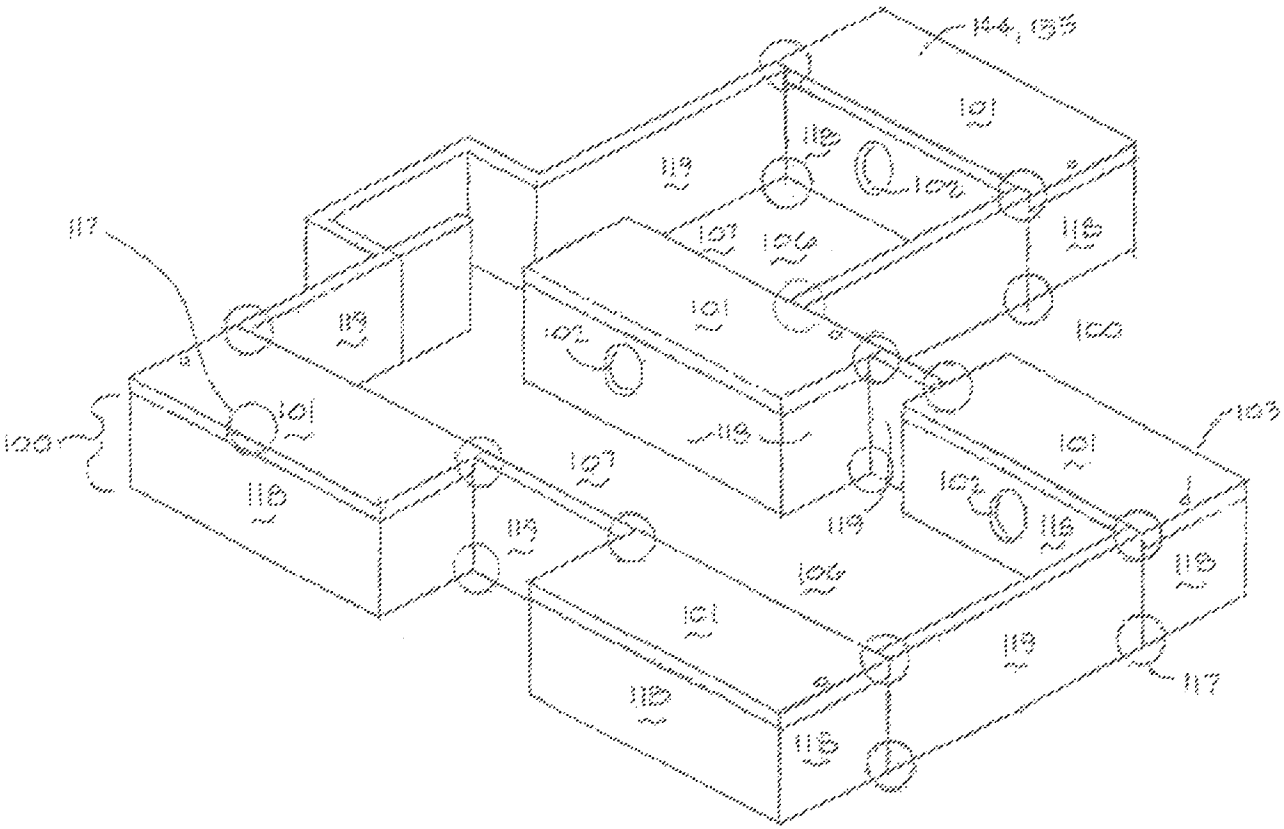
FIG. 1*a* is an isometric drawing showing an array of foundational cisterns forming a sealed, insulated crawl space.

The following detailed description is the best currently contemplated modes for carrying out the invention. The description is not to be taken in a limiting sense, but is made merely for the purpose of illustrating the general principles of the invention.

The principal purpose of the present invention, in one embodiment, is to utilize custom designed pre-cast concrete rainwater and non-potable water containment structures as adjunct building foundation components capable of supporting design loads of up to approximately 2,700 pounds per lineal foot at a building's perimeter load bearing locations.

The foundational cistern of the present invention is composed of four vertical walls (FIG. 1), which are attached to a floor section, forming the base unit 118. The four vertical walls may take on many dimensions and may form a variety of shapes. It is further contemplated that vertical wall reinforcement may be added or deleted to serve the needs of the building. In the preferred embodiment, four vertical walls are used. In this embodiment the two longer walls, that are opposite and parallel to one another, measure approximately 13 feet and 4 inches in width and 4 feet in height. The two shorter walls, that are positioned opposite and parallel to one another, in this preferred embodiment, measure approximately 5 feet 4 inches in width and 4 feet in height.

The floor section of the base unit 118, measures approximately 13 feet and 4 inches by 5 feet and 4 inches, in this preferred embodiment. The floor section of each foundation cistern, in one embodiment, would be thickened to approximately 6" in depth at specific locations whereby it would be possible to cast deformed reinforcing bars into the corner intersection formed by the floor of the tank and adjacent vertical walls. The reinforcing in this embodiment would allow the floor of the tank to react to the loads being transferred from the walls and lateral forces from the building structure above. The flat floor of the foundation cistern 158, in this embodiment, would then be seen as a foundation footing replacement in compliance and exceeding minimum code requirements of 16" wide×6" depth plain concrete footings. Moreover the remaining portion of the base is sloped 157 to augment evacuation of stored rainwater in the foundational cistern, as is further illustrated in FIG. 3, and described below.

One of the vertical walls contains an opening 102 that can be accessed by an average-sized person, and may serve as a maintenance hatchway. In the preferred embodiment, the access opening 102 is circular in shape, although other shapes may be implemented and contemplated, as would be known by one skilled in the art. The access opening 102 may be covered by a hinged or bolted door 116 having a gasket or "o" ring, thus preventing the egress of material contained within the foundational cistern. A hinged or bolted door 116 may be water tight, as in the preferred embodiment of the invention. In the preferred embodiment, the access opening 102 measures not more than approximately 24 inches in diameter.

In the interior of the base unit 118 of the foundational cistern, there is a concrete stiffener 104. The concrete stiffener 104 adds resistance to bending of the longer foundational cistern vertical walls when supporting loads by the building above. In a preferred embodiment of the present invention, the concrete stiffener 104 measures approximately 4 feet and 10 inches in width and approximately 1 foot and 10 inches in height, and its position ranges between approximately 1 foot 8 inches to 1 foot 10 inches above the floor section of the base unit 118. Additionally, knock out holes 129 may be present to accommodate overflow of liquid to prevent the foundational cistern from filling completely with fluid, as in the preferred embodiment. The structural integrity and rigidity of the present invention is further supported by reinforcing bars 120 running vertically through the four corners and middle of the wall opposite the wall containing the access opening 102. Reinforcing bars 120 also run horizontally through the foundational cistern base unit 118 floor 158. The pilaster column 115 allows the present invention to tolerate the loads imposed by the structure the foundational cistern is supporting. Either a bolted or weld plate connection 117 is present in both the top and the lower outer edge of the base unit 118 and top cover 101 unit that facilitates the connection of the foundational cistern to other foundational cisterns, pre-cast wall panels, or similar material, as in one embodiment of the invention. FIG. 1*a* illustrates the foundational cistern and its attachment to a pre-cast wall panel 119 and the pre-cast wall panel's 119 relationship to other structural elements of the building, a continuation of the pre-cast concrete panel 114 and rigid insulation 108. Other aspects and elements of the base unit 118 will be described below.

Figure 1B:
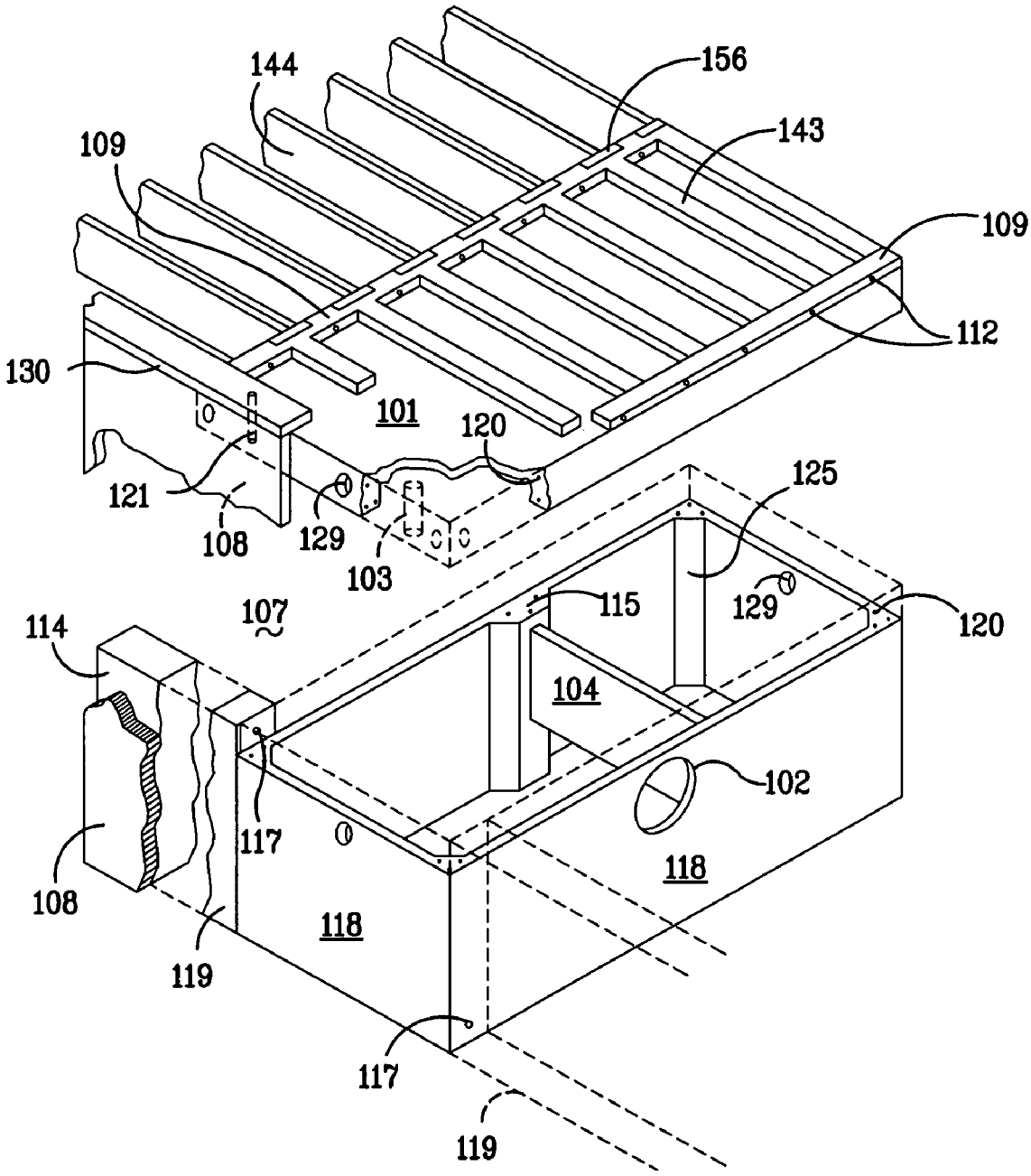
FIG. 1*b* is an isometric rendering demonstrating the relationship between wood framed floor and walls with the foundational cistern unit of the present invention, according to one embodiment.
Figure 3:
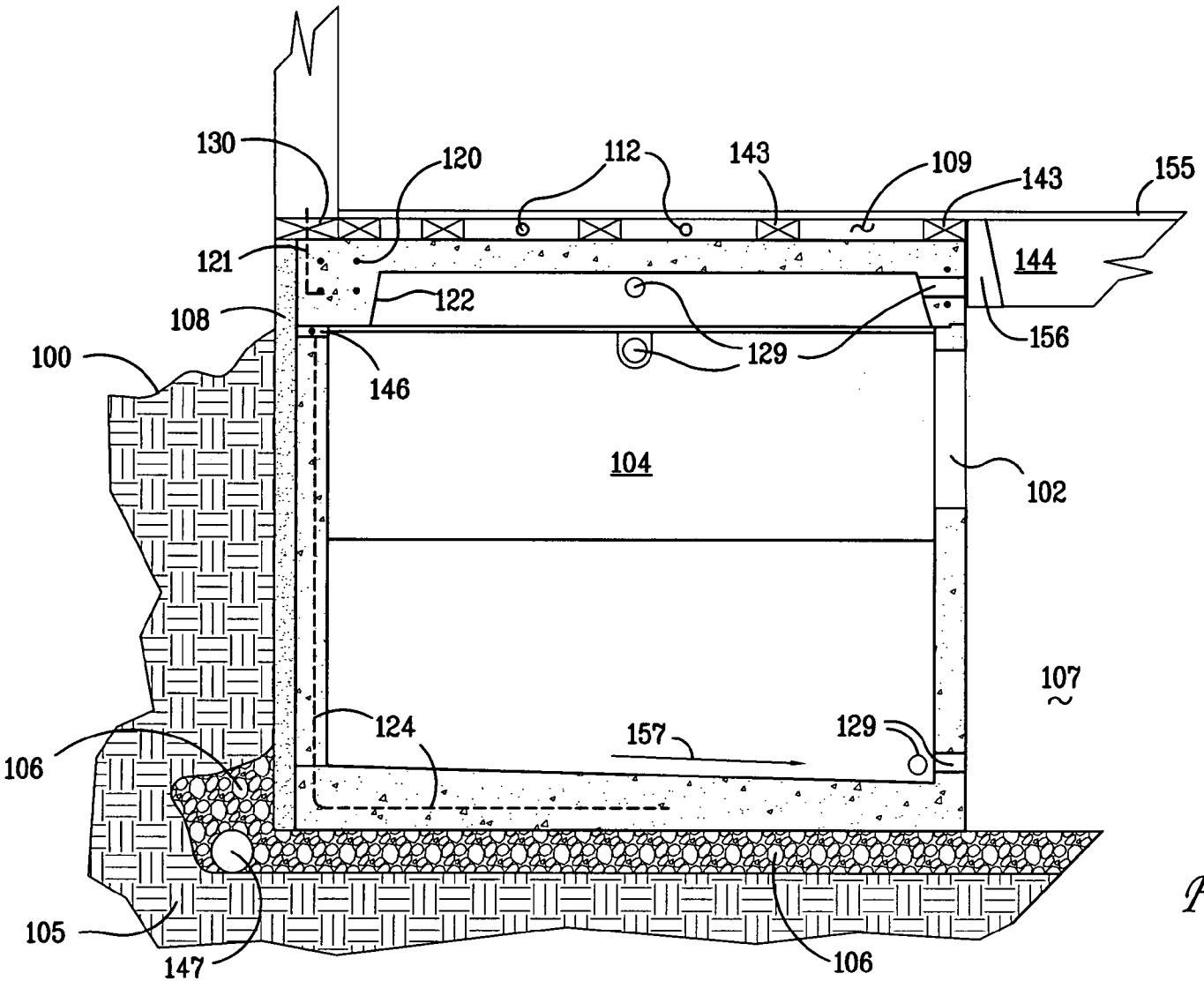
FIG. 3 is an illustration of a vertical cross-section of the foundational cistern, detailing elements and environment of use, according to one embodiment.

The base unit 118 of the foundational cistern sits on a specified gravel base 106 (see FIG. 3). The specified gravel base 106 sits on the compacted or undisturbed bearing soil 105. Perforated pipe 147 is used to prevent lateral transfer of ground water beneath the foundational cistern assembly. The foundational cistern may be connected to a pre-cast wall panel 119 by a bolt or welded anchor connection 117. In FIG. 1*b* a view of this connection is illustrated. More detailed views are shown in FIGS. 5*a*-5*e* and are described in more detail below. FIG. 1*b* illustrates the base unit of the cistern where the base unit 118 is connected to a pre-cast wall panel 119.

The top cover 101 of the present invention is placed on top of the base unit 118 for the foundational cistern to be operable. Thus, the top cover 101 is of a similar shape and plan area size as the base unit 118 in the final product. The top cover 101 may also be equipped with knock out holes 129 to allow the egress of excess fluid within the cistern and to accommodate transfer of stored water to nearby foundational cisterns, when present as in one embodiment. Additionally, a vent to the roof 103 is present, as in one embodiment, to allow the escape of air being pressurized or depressurized due to level changes in the water, as well as to vent water vapor from the cistern. Each of the four side edges of the top cover 101 contain reinforcing bars 120 to add strength to the cover. As shown in FIGS. 2*a*-2*d*, the edges of the top cover 101 are thickened and contain elements to withstand loads imposed by the building. Connection of the top cover 101 to the base unit 118 is further illustrated in FIGS. 3, 7 and 8 and is described below.

When in use, the top cover 101 is connected to pre-cast wall paneling 119 or rigid insulation 108 as in one embodiment of the invention. A sole plate 130 (approximately two by six, in one preferred embodiment of the invention) is placed beneath the top cover 101 and positioned by the presence of shaped keyways 146, as in one embodiment of the invention (see FIGS. 3 and 7). The sole plate 130 then connects to the subflooring 155, and furring strips 143 of the structure (see FIGS. 1*b* and 3). Above the top cover 101 the wall framing of the structure is placed in alignment with the sole plate 130. The top cover 101 is attached to the sole plate 130 by an anchor bolt 121 (further described below). Two by four (or two by two, as in another embodiment) furring strips 143 are placed on the top cover 101, and radient heat distribution openings 112 are provided at the edges of those furring strips 143 that facilitate heating or cooling air flow from the foundational cistern to the building. Moreover, top mounted flange 156 are present in the flooring, as are floor joists 144 and a treated horizontal ledger 109 as illustrated in FIG. 1*b*.

Figure 2A:
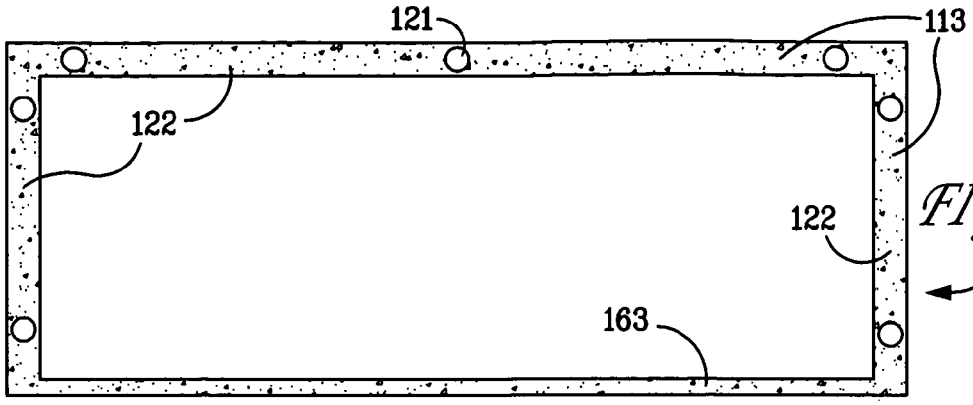
FIG. 2*a* is an illustration of the underside (typical) of an optional top cover unit configuration, identifying load bearing concrete positions of the foundational cistern of the present invention, according to one embodiment.
Figure 2B:
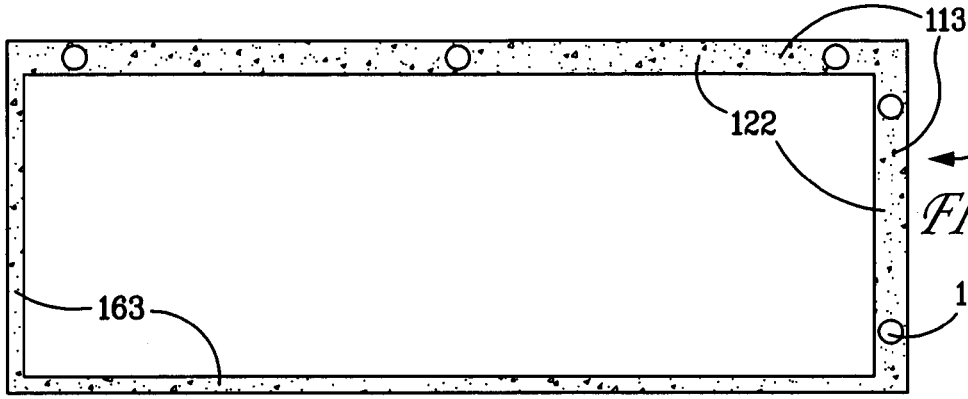
FIG. 2*b* is an illustration of the underside of an alternative top cover unit configuration, identifying load bearing concrete positions of the foundational cistern of the present invention, according to one embodiment.
Figure 2C:
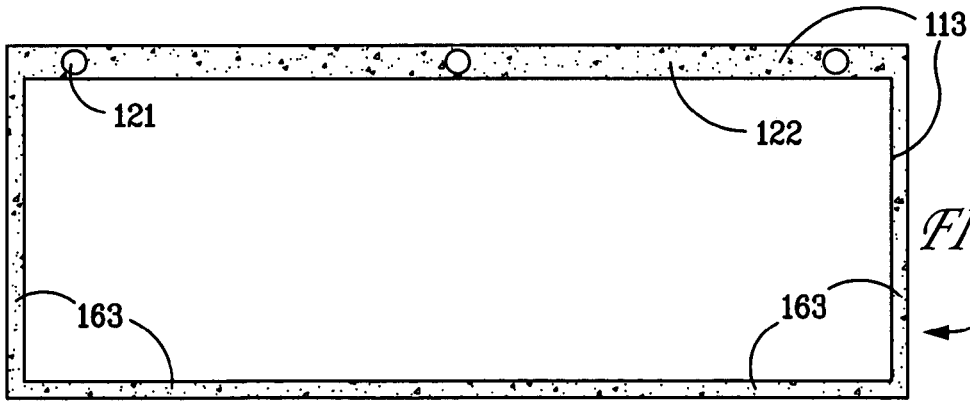
FIG. 2*c* is an illustration of yet another underside top cover unit configuration, identifying load bearing concrete positions of the foundational cistern of the present invention, according to one embodiment.
Figure 2D:
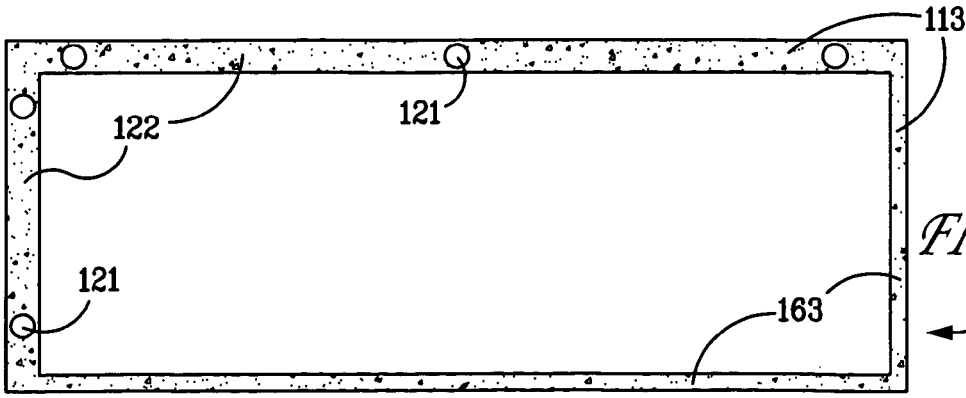
FIG. 2*d* is an illustration of still an additional underside top cover unit configuration, identifying load bearing concrete positions of the foundational cistern of the present invention, according to one embodiment.

FIGS. 2*a*-2*d* are illustrations of the underside portion of the top cover 101 of the foundational cistern, focusing on the turn down and lintel edges 122 of the top cover 101. Anchor bolt 121 connections are depicted and illustrate potential locations where the top cover 101 may be attached to the subflooring 155. FIGS. 2*a*-2*d* show multiple turn down edges, locations 122 and 113, and at load bearing walls. In the preferred embodiment, the primary load bearing turn down lintels 122 are 8 inches by 8 inches having 64 square inches of 5,000 psi concrete cross sectional area at all reinforced concrete lintel locations. Lintels and turn down edges are also depicted in FIG. 3. Note that turn down edges 113 may be present on any vertical wall of the top cover 101. FIG. 2*a* shows turn down lintels 122 on three sides of the top cover 101 where primary structural building loads are anticipated, as in one embodiment. It is contemplated and useful to include non-structural turn down edges 163 on only one side (FIG. 2*c*), two sides (FIGS. 2*b* and 2*d*), or three sides (FIG. 2*a*). Moreover, monolithic turn down lintels 122 are only utilized where either continuous or point primary load reactions are anticipated from the building being supported by the foundational cistern, as is consistent with one embodiment of the invention. The top cover 101 rests on top of the base unit 118, and is sealed thereon by way of a keyway seal at the joint 146. This element is further described in FIGS. 7 and 8.

FIG. 3 further illustrates detailing of the present invention. For instance, as in one embodiment of the invention, a treated horizontal ledger 109 (2 by 4) is in contact with the top cover 101. Other elements of the subflooring 155, 143, 144, and 156 are described above and further illustrated in FIG. 3. The relationship of the anchor bolt 121 to the subflooring above the top cover 101 is also illustrated in FIG. 3. The slope 157 of the bottom floor of the base unit 118 is also shown. The 8 by 8 lintels 122 that provide load-bearing support to the structure above are also depicted. The keyway seal at joint 146 between the top cover 101 and base unit 118 is also shown, as is the access opening 102. Reinforcing dowels 124 that provide structural rigidity to the present invention are also shown. Knock out holes 129 that may be opened to admit rain water or to prevent the cistern from filling entirely with liquid are shown in a variety of positions. As would be known by one skilled in the art, there may be only one, or a multitude of knock out holes 129 that be present in a plurality of positions.

The environment surrounding the foundational cistern is also shown in FIG. 3. Earth backfill 100 is used to stabilize and insulate the present invention, as is practiced in one embodiment. In one preferred embodiment, earth backfill 100 is present up to 4 feet in height at the exterior sides of the base unit 118 and wall panels 119. Transference of loads from the bottom of the foundation cistern tanks of the present invention to bearing soils would be negotiated by use of approximately 4" thick gravel base 106 placed on undisturbed grade or compacted select fill in one embodiment. The gravel medium 106 would be drained via use of industry standard 4" diameter perforated plastic pipe 147 to daylight or gravel sump as is known in the art. Some soil types would require further consideration, yet still employ the present invention. The other side of the foundational cistern, in this preferred embodiment is the sealed crawlspace 107.

Figure 4:
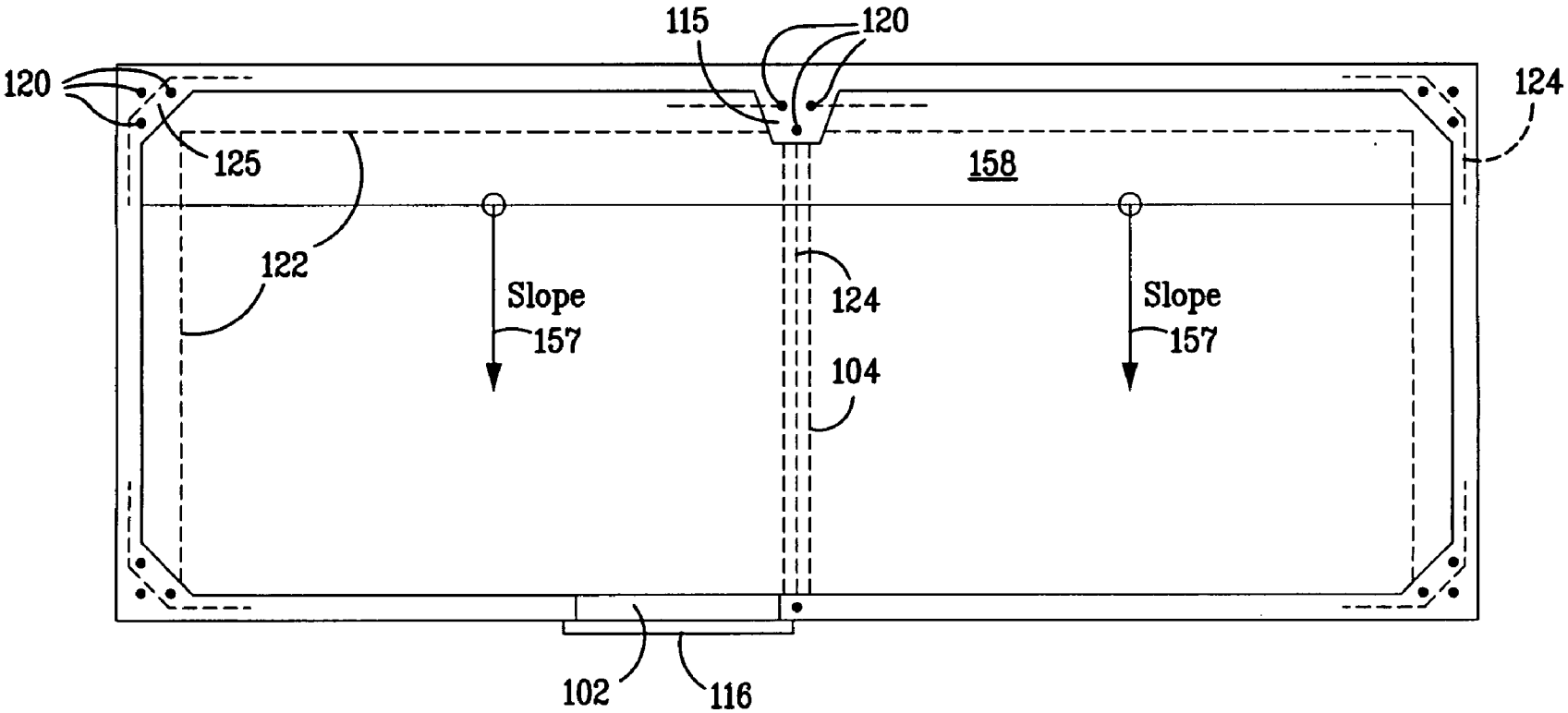
FIG. 4 is a depiction of a horizontal cross-section of the present invention demonstrating thickened corner, columns, pilaster column, web stiffener, and access hatch opening, in one embodiment.

FIG. 4 shows a horizontal cross-section of the present invention. This view provides added understanding to elements like the pilaster column 115 that provides added structural support to the mid-section of the present invention. Reinforcing bars 120 are shown in the four corners and mid section of the foundational cistern, as in one embodiment of the invention. Also shown, are the thickened corners 125 of the present invention, which provide depth of concrete for connections, and vertical transfer of building loads from above. Monolithic turn down lintels 122 described in FIGS. 2*a*-2*d* are also identified in FIG. 4. The concrete stiffener 104 is in contact, on both sides, with reinforcing dowels 124, which provides added structural support to the mid-section of the foundational cistern. The access hatch opening 102 and vertical door assembly 116 are also shown.

Figure 5A:
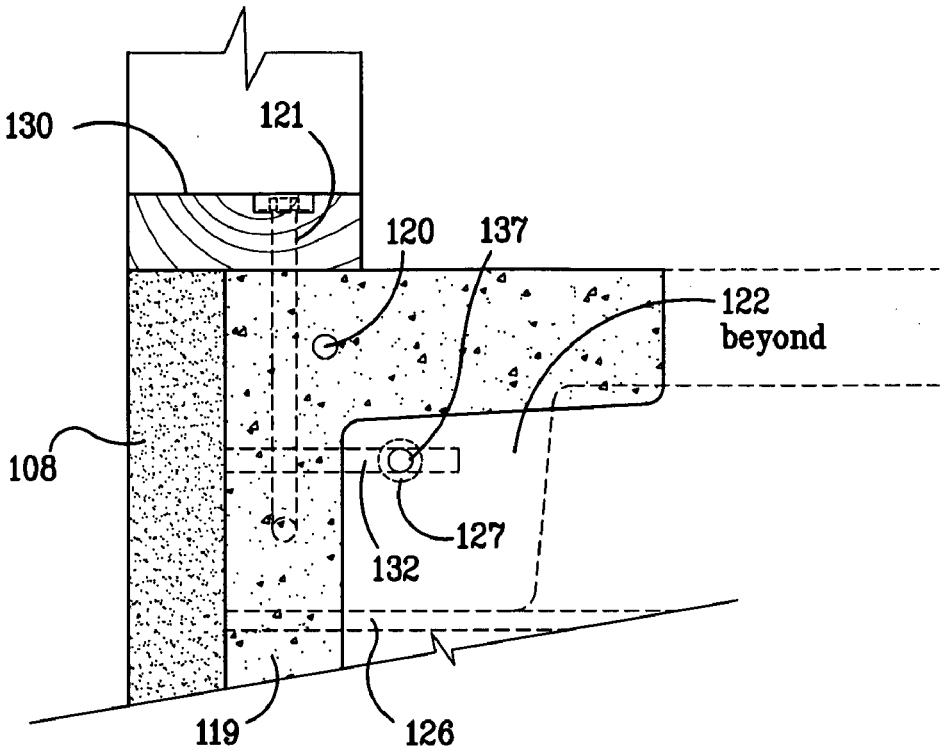
FIG. 5*a* is a vertical section view at a pre-cast wall panel illustrating connection of the top cover of the present invention to an adjacent pre-cast concrete wall panel, according to one embodiment.

FIG. 5*a* is a vertical section view at a pre-cast concrete wall panel 119. The top cover 101 of the foundational cistern is connected to the subflooring above through the use of an anchor bolt 121 that connects the top cover 101 to an offset sole plate 130, as in one preferred embodiment of the invention. As demonstrated the sole plate 130, and pre-cast wall panel 119 are in connection with the rigid insulation 108 of the building. Other means of fastening concrete to subflooring are known and may be contemplated by one of ordinary skill in the art. A nut and washer 127 may be used on the wall framing anchor bolt 121 to secure a structural connection between the foundation cistern and the building, or structure, above it. The opening used to house the galvanized bolt 137 is cast oversize in order to follow with a grouted connection of the imbedded bolt 137 used for connecting the foundational cistern assembly to adjacent foundation components. This method is used for other openings in concrete described in this invention. Reinforcing bars 120 are present in the top cover 101 as identified previously. The 8 by 8 lintel 122 is also identified (as described in FIGS. 2*a*-2*d*). A ½ inch shim space 126 is present to allow leveling of the top cover 101 once it is placed on the base unit 118 of the present invention, which allows a means of leveling the top cover 101 to required building tolerances. An injection channel 132 is provided for the purpose of completely filling the oversized opening with epoxy grout to assure complete coverage of the bolt 137.

Figure 5B:
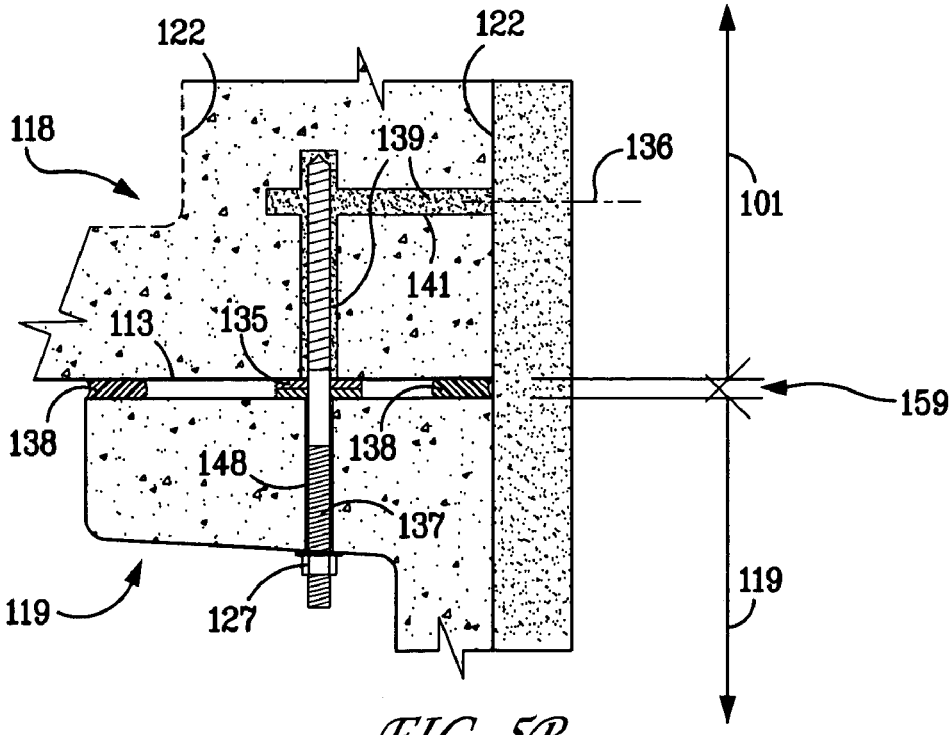
FIG. 5*b* is a plan section view of the connection of the top cover of the present invention to base unit, and connection to a pre-cast wall panel, in one embodiment of the present invention.

FIG. 5*b* shows a plan section at the lower galvanized bolt 137, showing the connection of the base unit 118 and the pre-cast concrete wall panel 119. A one-inch cast opening 141 may be sealed with epoxy grout 139 after connection. The one-inch cast opening 141 is placed 4½ inches from the bottom of the top cover 101 of the unit and 4½ inches from the bottom of the base unit 118, as in one preferred embodiment. As shown, the monolithic turn down edge 113 portion of the top cover 101 is used, as in one embodiment. The 11/16 opening 148 is placed 4½ inches from the outside edge of the pre-cast concrete wall panel 119, and is directed through the pre-cast concrete wall panel 119 and into the top cover 101 for about 5 inches, in the monolithic turn-down lintel 122 portion of the top cover 101, as in one preferred embodiment of the invention. The lower cast opening 148 may have a galvanized bolt 137 (in one preferred embodiment a ⅝ galvanized bolt), that is secured by a nut and washer 127 (and in one preferred embodiment, a 1¾ inch washer) and connects the pre-cast concrete wall panel 119 to the base unit 118 of the foundational cistern. The opening 141 may be filled with epoxy grout 139 in the finished product of the present invention. The shim space 159 between the top cover 101, base unit 118 and pre-cast concrete wall panel 119 may be sealed with caulk 138 and accommodate shim washers 135 (and in one preferred embodiment ⅛ inch thick shim washers), and sealant 133. The number of shim washers can be adjusted to compensate for variations in distance between adjacent precast foundation components, i.e., the base unit 118 and pre-cast concrete wall panel 119, as is apparent to one skilled in the art. In one preferred embodiment, the sealant 133 used in conjunction with the present invention is nominally about ½ inch thick wide and of a depth as prescribed by the sealant manufacturer, however it is contemplated that other sealants including elastomeric caulking and the like may be used and would be apparent to one skilled in the art. A similar bolt connection and injection channel 136 in the top cover 101 is also shown in FIG. 5*a* which is intended to align adjoining base units 118 and top covers 101 of additional foundational cisterns vertically and can be employed for the attachment of the top cover 101 to other cistern units or pre-cast wall panels.

Figure 5C:
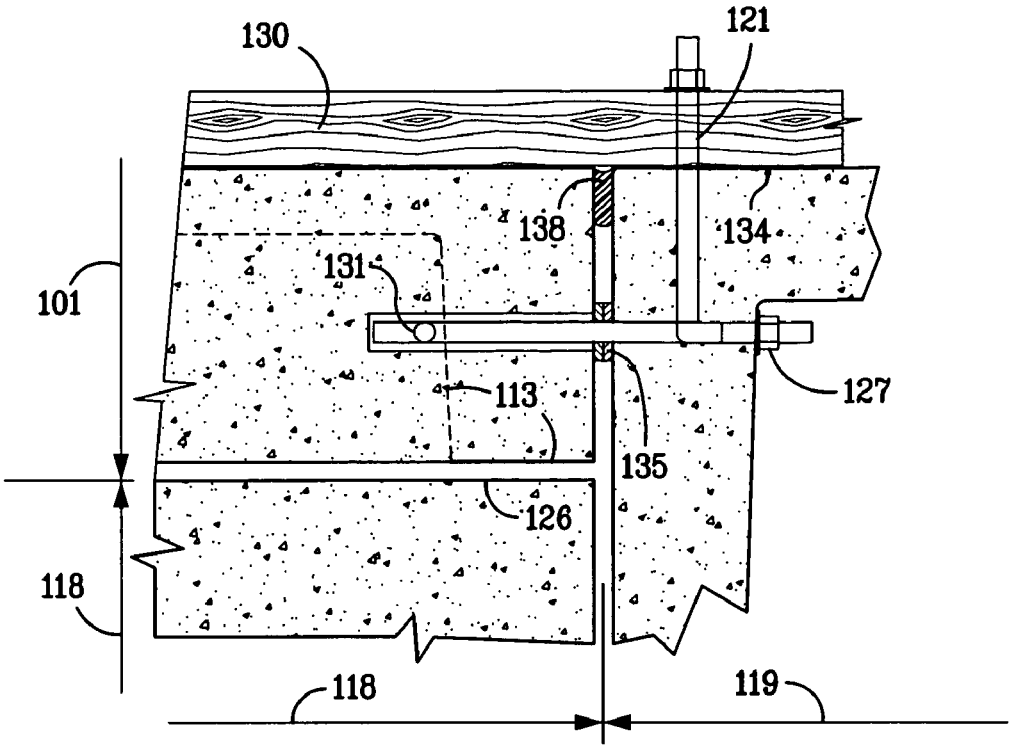
FIG. 5*c* illustrates, in a vertical section view, the detail of the connection between the top cover of the present invention and a pre-cast concrete wall panel, as in one embodiment.

An elevation view bolt connection at the top cover 101 adjacent to a pre-cast concrete wall panel 119 is shown in FIG. 5*c*. An anchor bolt 121 secures a sole plate 130 (that is part of the subflooring for the structure above), to the pre-cast wall panel 119, which is adjacent and level with the top cover 101 of the foundational cistern. In one preferred embodiment, the anchor bolt 121 continues 5 inches into the pre-cast wall panel 119 at its strongest location (corner). Other attachment means would be appropriate and are known by those skilled in the art. Between the underside of the sole plate 130 a compressible filler 134 is placed between the top of the cover unit 101, where there is a monolithic turn-down edge 113, and the underside of the sole plate 130 to form an infiltration barrier preventing exposure to convected outdoor unconditioned air. A retaining pin 131 restrains the bolt from being pulled out. Bolts may be held in place by injecting epoxy grout. In the space between the top cover 101 and pre-cast wall panel 119, flat washer shims 135 may be used as needed to occupy the space 126. Sealant or caulk 138 may be used to occupy the exterior and interior perimeter of that space. Between the top cover 101 and lower base unit 118, shim space 126 is present to allow flexibility for leveling of the top cover 101 before the subflooring is placed. In one preferred embodiment, the shim space 126 is approximately ½ inch.

Figure 5D:
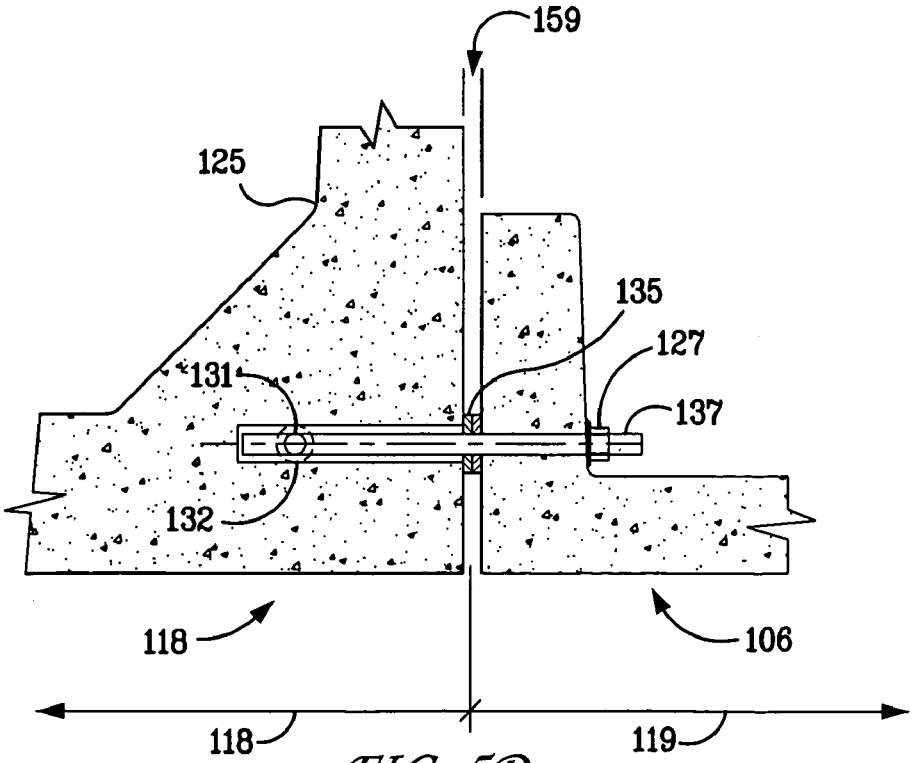
FIG. 5*d* is a horizontal section illustration of a typical bolt connection between the base unit and a pre-cast concrete wall panel, as in one embodiment of the present invention.

A detailed view of the connection between the base unit 118 and a pre-cast wall panel 119 is shown in FIG. 5*d*. To facilitate connection of the base unit 118 of the foundational cistern and a pre-cast wall panel 119, an injection channel 132 (that is 5 inches deep into the base unit in the preferred embodiment) is used to accommodate insertion of the retaining pin 131 and epoxy grout. That bolt 137 may be held in place within the pre-cast base unit 118, in part through the use of a nut and washer 127, thence subjected to use after approximately 24 hours, as in one preferred embodiment. Other means of fastening and securing fasteners to the pre-cast wall panel 119 and base unit 118 are contemplated and known by those skilled in the art. This view also provides further detail as to the thickened and reinforced concrete corner 125, which is present in all four of the base unit 118 corners. A shim space 159 is present in between the base unit 118 and pre-cast wall panel 119 that may be secured with sealant as previously described. Flat washer shims 135 may be used to occupy that space where the bolt 137 is placed between the base unit 118 and pre-cast wall panel 119. Also note that the base unit 118 and pre-cast wall panel 119, sit on a gravel base 106, as depicted in FIG. 3.

Figure 5E:
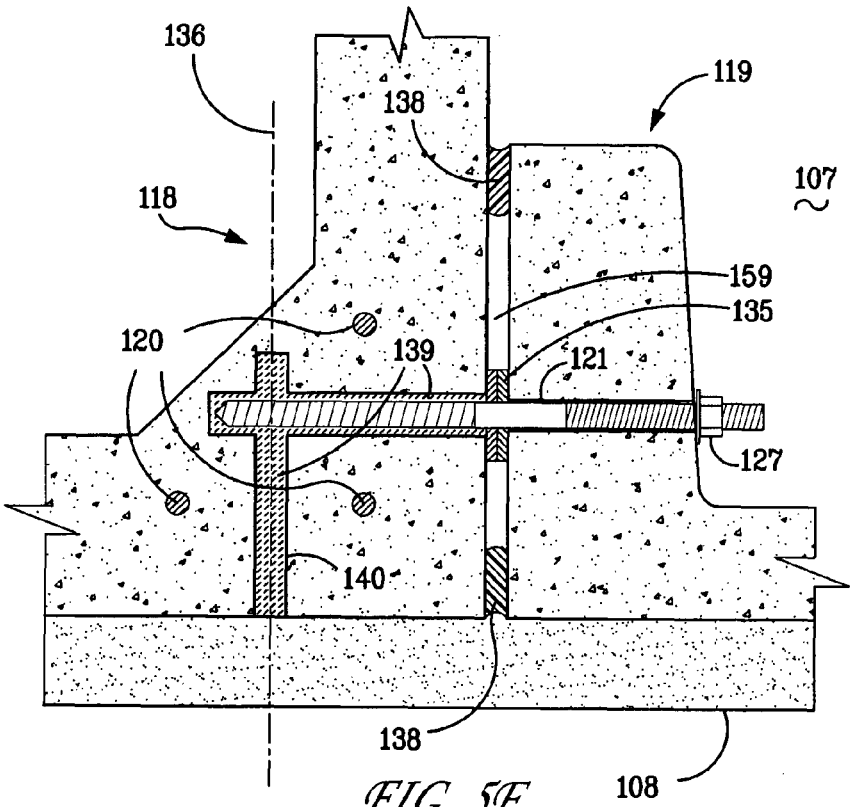
FIG. 5*e* is a rendering of a horizontal section view of a connection between the base unit and a pre-cast concrete wall panel, as in one embodiment.

FIG. 5*e* is a plan section at the lower anchor bolt. Continuous layers of rigid insulation 108 are adjacent to both the base unit 118 and pre-cast concrete wall panel 119. Between the base unit 118 and pre-cast concrete wall panel 119, a shim space 159 is present, which may be occupied by caulk 138 at its exterior locations to a depth as prescribed by the caulking or sealant manufacture, as is apparent to one skilled in the art. In one preferred embodiment, the shim space 159 is approximately ½ inch, and may be occupied by flat washer shims 135. An opening to facilitate connection of the base unit 118 to the pre-cast wall panel 119 houses a bolt 121 that is secured to the pre-cast concrete wall panel 119 by a nut and washer 127. This opening is located approximately 4 and ½ inches from the edge of the base unit 118 and pre-cast concrete wall panel 119 and may be filled with epoxy grout 139. A second opening 136 in the base unit 118 is formed by use of temporary polystyrene filler at the channels 140 and may be used as an alternative bolt channel connection. These one-inch diameter opening injection channels and alternate bolt connection 136 may house a galvanized anchor bolt accessible for installation at the interior crawl space side of the wall. Reinforcing bars 120 that add rigidity to the foundational cistern are labeled for reference. The crawlspace 107 is also denoted to show the environment of the invention associated with the attached pre-cast wall panel 119.

Figure 6A:
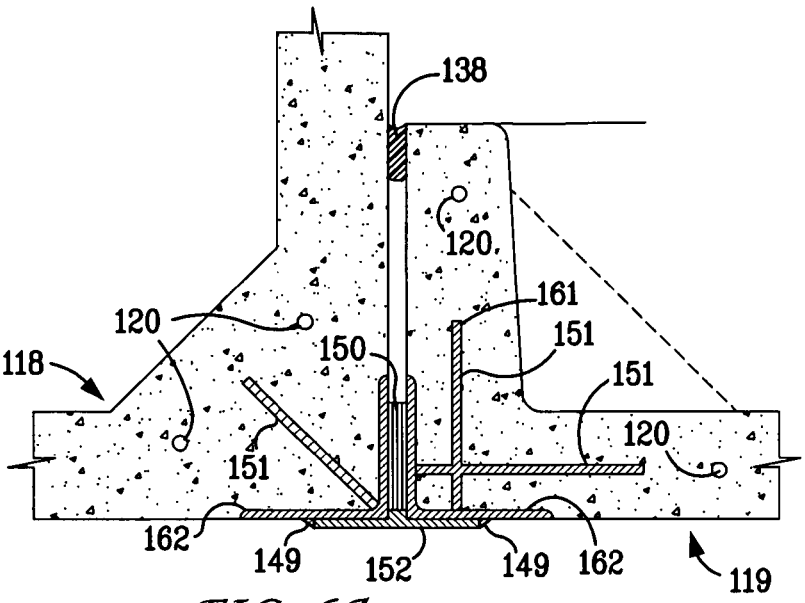
FIG. 6*a* is a horizontal plan section illustrating an alternative connection between a foundational cistern and a precast concrete wall segment, as in one embodiment.

FIG. 6*a* shows a plan section at the embedded weld plates 162, which provides an alternative to the bolted connections previously described. A fillet weld 149 is used to connect the two components, here a base unit 118 and pre-cast wall panel 119, via a 6 inch by 6 inch weld plate 152. A 6-inch deformed bar 151, as in one preferred embodiment of the invention, facilitates the structural connection of the steel angle 162 to the concrete cistern. Reinforcing bars 120 are denoted in the cistern corner and used for increasing structural connection strength. Space between the cistern and the adjacent structure is adjusted by steel shims 150 and sealed with caulk 138. An alternative bolt connection or cast-in and deformed bar 161 is also shown. A weld plate 152 forms a high strength connection between either two adjacent cisterns 118, or a foundational cistern 118 and adjacent pre-cast concrete wall 119.

Figure 6B:
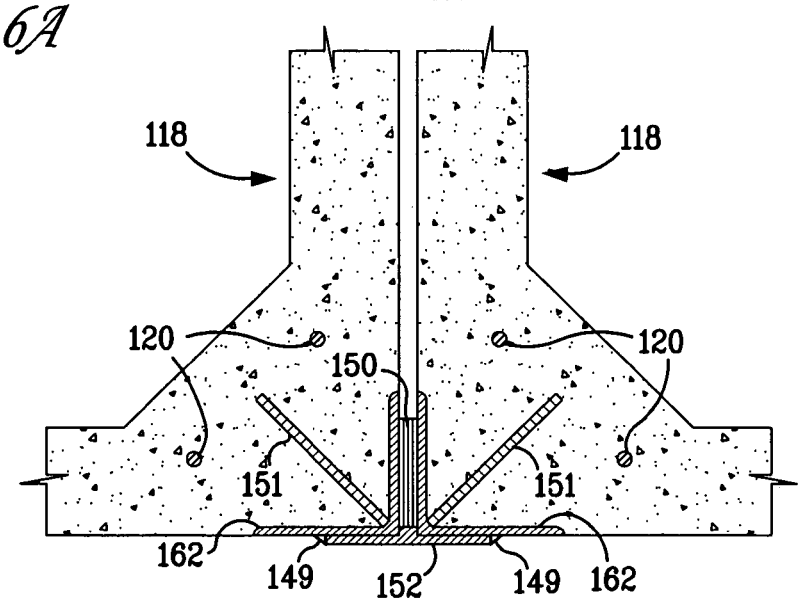
FIG. 6*b* is a horizontal plan section demonstrating the interior section view of an alternative connection between two adjacent foundation cisterns, as in one embodiment.

FIG. 6*b* closely parallels the welded connection design purpose described in FIG. 6*a*. It has the primary function of joining two adjacent base units 118, along with their respective top covers 101. This combination thereby avoids the need of exposing any connection hardware penetrations to the stored rainwater.

Figure 6C:
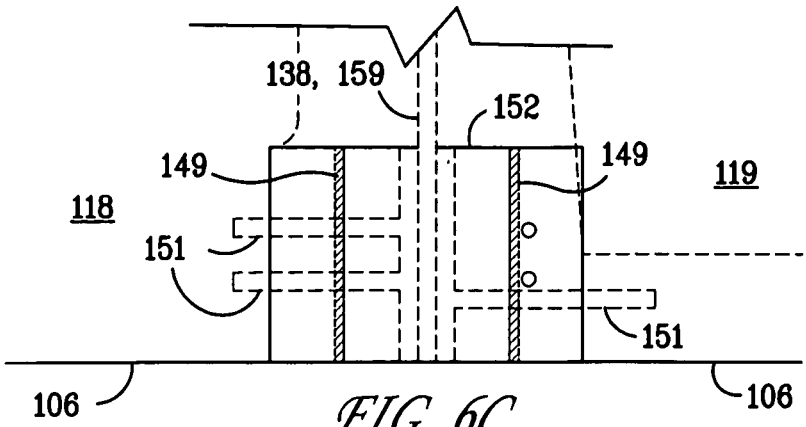
FIG. 6*c* is an elevation view showing a welded connection between two adjacent foundation cisterns, as in one embodiment.

FIG. 6*c* is an elevation view showing how the weld plate 152 is connected via two fillet welds 149, the individual embedded steel angles 162, which are each cast in their respective base units 118 or to a pre-cast wall panel 119. As such, the base unit 118 and pre-cast wall panel 119 are shown resting on the gravel base 106. As in FIG. 6*b*, isolation of all connection components from stored rainwater is achieved.

Figure 7:
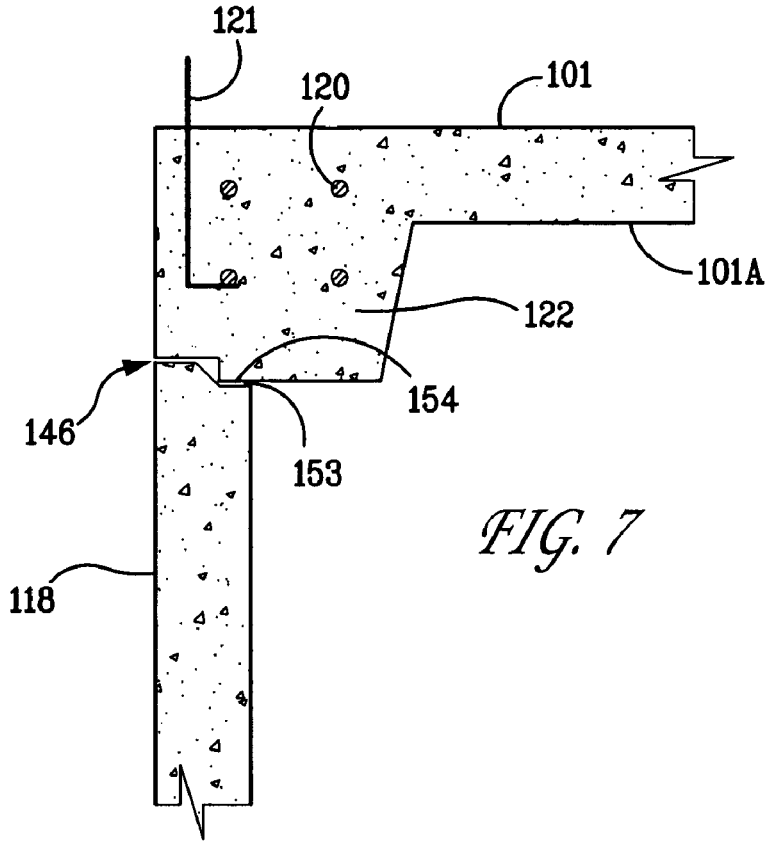
FIG. 7 is a vertical section rendering of the top cover primary load bearing lintel section and base unit of the present invention, in cross section, as in one embodiment.

The top cover 101 and its relationship to the base unit 118 is further shown in FIG. 7. The anchor bolt 121 used to connect the top cover 101 to subflooring is shown. The reinforcing bars 120 that run horizontally through the top cover 101 are denoted. In one preferred embodiment, the reinforcing bars 120 are approximately 2 and ⅛ inches from the side edge of the top cover 101, and approximately 2 and ¼ inches from the top edge of the top cover 101. The reinforcing bars 120 are approximately 3 and ¾ inches from one another to form a square pattern, as in one preferred embodiment of the invention. As is well known in the art, other patterns of placing the reinforcing bars 120 varying in number and size may be used to accomplish the same task, assuring the structural integrity of the top cover 101. The lower left reinforced bar is approximately 2 and ½ inches from the bottom edge of the top cover 101, as in one preferred embodiment of the invention. The top cover 101 at its outer edge is overall approximately 8 and ¾ inches in the preferred embodiment of the invention. Portions of the top cover 101 that are not at the edges are approximately 3 inches thick in this preferred embodiment. The space between the top cover 101 and the base unit 118, which is identified as a keyway seal or joint 146 in FIG. 3, is filled with nonshrink grout 153. Proper infill of the keyway 146 with nonshrink grout 153 produces a shimming effect 154. Such space is necessary to level the top cover 101 so it is appropriate to support the subflooring of the structure. The tapered uppermost wall of the base unit 118 is approximately 3 inches wide near the connection of the base unit 118 to the top cover 101. The monolithic turn down lintel 122 provides lateral transfer of concentrated and uniformly distributed building structural loads, loads to pilaster columns 115, and thickened corners shown in FIGS. 1*a* and 1*b*.

Figure 8:
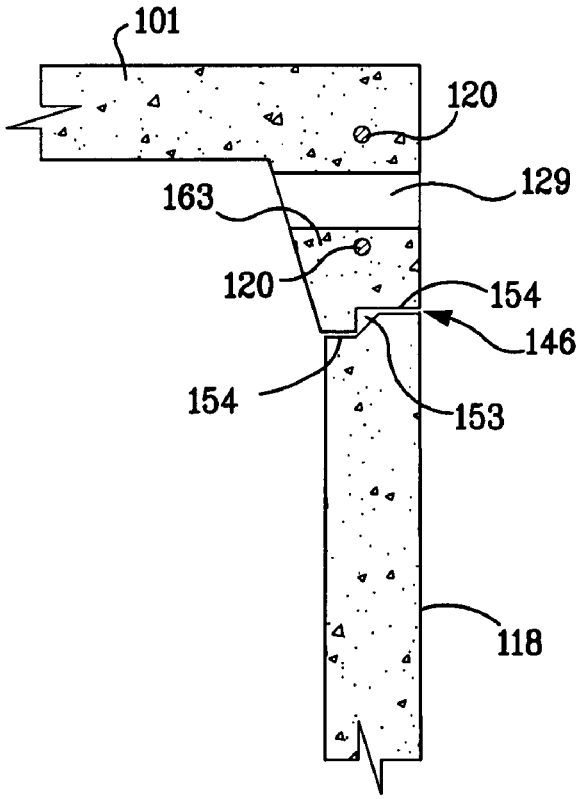
FIG. 8 is a vertical section illustration of the non-primary load bearing top cover turn down edge with a knock out hole and the keyway at base unit of the present invention, as in one embodiment.

A detailed cross-section of the present invention is shown in FIG. 8. This illustration further depicts the relationship between the top cover 101 and base unit 118 of the foundational cistern, and the keyway seal at joint 146. Reinforcing bars in the top cover 120 are shown at openings in excess of 3 inches in diameter, as well as knock out holes 129, which may be present to allow the ingress and egress of material contained within the cistern. Sealant, nonshrink grout 153 and grout shims 154 are used to seal the top cover 101 to the base unit 118 after the top cover has been leveled 101 appropriately for the subflooring of the structure to be placed on top of it. The non primary load bearing monolithic down turn edge 163 is designed to carry approximately 60 pound live loads and approximately 10 pound dead loads transmitted over spans not exceeding approximately 16 feet of uniform loading.

Structures to be supported by the present invention, in one embodiment, would involve light framed Type V building construction, as is known in the art. Associated loads typically are anticipated to be continuous. Point loads can be accommodated as needed where turn down lintels 122 are present. Load transfer, in the preferred embodiment, would occur near the outside framing line of structures above and across a typical 2 by 6 dimensional sole plate 130 bolted to imbedded anchor bolts 121 per IBC code and equivalent requirements. These vertical structural loads from above the foundation cistern of the present invention would then be transferred onto the pre-cast concrete wall section of the foundation cistern located immediately beneath the anchored sole plate, which is to be secured via these embedded bolt connections (see FIGS. 5*a*, 5*c*, 5*d*, and 5*e*).

Currently, typical septic tank vertical wall sections are a minimum of 2¾" in thickness. By comparison, Superior Wall pre-cast sections, that may be used in one embodiment of the present invention, are using about 1¾" thick sections. The IBC code table 1805.5 (1) requires a minimum of 7½" thickness of plain concrete to restrain unstable backfill exceeding 4' in height. Assuming a design constraint of a maximum backfill depth of less than 4', local building officials can approve use of engineered (depth dimensions exceeding the 2¾" minimum) vertical septic tank walls, as may be used in one embodiment of the present invention. Thickness of the walls of the present invention may vary as required to restrain less than four feet of unbalanced backfilled soil, while addressing lateral load reactions from various dynamic loads.

Either ⅝" diameter bolt cavity spaces or embedded plates with attendant deformed bar anchors (similar to pre-cast concrete tilt wall components) would be cast or "let-in" the exposed surfaces of the upper and lower outside corners of each foundation cistern bearing wall in one embodiment. These bolts, or plates, when properly aligned, would enable individual foundation cistern units to be attached to one another in this embodiment (see FIGS. 5*b*, 5*c*, 5*e*, 6*a*, 6*b*, and 6*c*). Once connections are completed, it is anticipated the attached series of foundation cistern tanks would then be capable to reacting to differing soil bearing pressures and building loads imposed from above, in unison (see FIG. 1*a*). That is to say their attached exterior concrete walls would serve as a continuous structural diaphragm up to a specified design load limit to be governed by the overall length of the attached foundation cistern array, and point loads being imposed by building framing above.

Live load characteristics affecting the individual units of the present invention must be taken into consideration, as the foundation cisterns are planned for use as water containment vessels having a fill level of up to 4 feet in depth, in one embodiment. In one embodiment of the present invention, total loads acting on the bearing soil include: LL and DL of structure above, LL and DL of foundation cistern including up to 1,500 gallons of water in a nominal 12 foot by 4 foot plan area at the floor of the cistern, and DL of gravel all cumulatively acting on bearing soil.

Moreover, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Thus, it is intended that the invention cover all embodiments and variations thereof as long as such embodiments and variations come within the scope of the appended claims and their equivalents.

I claim:

1. A foundational cistern capable of supporting a building that is of a larger footprint than that of the cistern comprising a container comprising a base unit and a top cover, said base unit having an opening, four vertical walls, and a floor; and said top cover is independent of the floor of the building and capable of being attached to the subfloor of the building, is of similar shape to fit on top of said base unit; and wherein the base unit and the top cover are manufactured with concrete, the concrete containing reinforcing bars, and the concrete being thicker at the four corners of the base unit and between two of the four corners of the base, and the edges of the top cover also being thickened; wherein the container is capable of supporting the building that imposes static and live loads up to approximately 2,700 pounds per lineal foot of foundation wall perimeter; where one of the four vertical walls has a sealable opening for maintenance of the foundational cistern; the edges of the underside of said top cover having turn down and lintel edges where primary structural building loads are anticipated, and the container may hold a liquid therein.

2. The foundational cistern of claim 1, wherein the base unit and top cover contain at least one hole that may be covered.

3. The foundational cistern of claim 1, wherein the top cover is equipped with at least one attachment means that may be used to connect the top cover to other structural elements of said building.

4. The foundational cistern of claim 1, wherein the base unit is equipped with at least one attachment means having the ability to connect the base unit to another structural element of the building as well as being capable of attachment to similar foundational cisterns positioned next to the original foundational cistern creating a foundation cistern array capable of supporting buildings of unlimited plan area size.

5. The foundational cistern of claim 1, wherein the container is equipped with at least one attachment means having the ability to connect the container to another container, creating a foundation cistern array capable of supporting buildings of unlimited plan area size.

6. The foundational cistern of claim 1, wherein the container is equipped with at least one attachment means having the ability to connect the container to another foundational cistern.

7. The foundational cistern of claim 1, wherein said turn down and lintel edges of said top cover are load bearing architectural elements constructed from reinforced concrete.

8. The foundational cistern of claim 1, wherein said base unit of said foundational cistern is placed on a gravel base, the gravel base providing an extraction medium for the control and elimination of radon gas.

9. A foundational cistern capable of supporting a building that is of a larger footprint than that of the cistern comprising: a base unit substantially constructed from concrete and having four vertical walls, a concrete stiffener that is parallel with two of the vertical walls and is positioned in the mid-section, an opening in one of said four vertical walls that may be covered by a water tight door for the purposes of maintaining the foundational cistern, and a top cover substantially constructed from concrete and having four sides, wherein the top cover is independent of a floor of the building and capable of being attached to a subfloor of the building, and wherein the edges of the four sides of the top cover being thicker than the middle of the top cover and capable of being in contact with the four vertical walls of the base unit when the top cover is placed on said four vertical walls, said top cover having the ability to have holes in the edges of the four sides; wherein thickening of the concrete and reinforcing bars within the concrete strengthen the container such that the container may support the building imposing static and live loads up to approximately 2,700 pounds per lineal foot of foundation wall perimeter; and the edges of the underside of said top cover having turn down and lintel edges located where primary building loads are anticipated; the foundational cistern being equipped to connect to other containers or structural elements of the building; and said container capable of holding a liquid therein.

10. The foundational cistern of claim 9, wherein the base unit and top cover contain at least one hole that may be covered.

11. The foundational cistern of claim 9, wherein the top cover is equipped with at least one attachment means that may be used to connect the top cover to other structural elements of said building.

12. The foundational cistern of claim 9, wherein the base unit is equipped with at least one attachment means having the ability to connect the base unit to another structural element of the building.

13. The foundational cistern of claim 9, wherein the container is equipped with at least one attachment means having the ability to connect the container to another container as well as being capable of attachment to similar foundational cisterns positioned next to the originating foundational cistern creating a foundation cistern array capable of supporting buildings of unlimited plan area size.

14. The foundational cistern of claim 9, wherein the container is equipped with at least one attachment means having the ability to connect the container to another foundational cistern.

15. The foundational cistern of claim 9, wherein said turn down and lintel edges of said top cover are load bearing architectural elements constructed from reinforced concrete.

16. The foundational cistern of claim 9, wherein said base unit of said foundational cistern is placed on a gravel base, providing an extraction medium for the control and elimination of radon gas and replacing the use of site cast concrete continuous wall or pier wall footings.

17. A foundational cistern capable of supporting a building that is of a larger footprint than that of the cistern comprising: a base unit substantially constructed from concrete and having four vertical walls, a floor, a concrete stiffener that is parallel with two of the vertical walls and is positioned in the mid-section, an opening that may be covered by a water tight door for the purposes of maintaining the foundational cistern interior, and a pilaster column in the mid section of the base unit; and a top cover substantially constructed from concrete and having four sides wherein the top cover is independent of a floor of the building and capable of being attached to a subfloor of the building, and wherein the edges of the four sides of the top cover being thicker than the middle of the top cover and being able to be in contact with the four vertical walls of the base unit when the top cover is placed on the four vertical walls opposite the floor, said top cover having the ability to have holes in the edges of the four sides; wherein thickening of the concrete and reinforcing bars within the concrete strengthen the container such that it may support the building imposing static and live loads up to approximately 2,700 pounds per lineal foot of foundation wall perimeter; and the edges of the underside of said top cover having turn down and lintel edges where primary building loads are anticipated; the foundational cistern being equipped to connect to other containers, other foundational cisterns, or structural elements of the building; and said container capable of holding a liquid.

18. The foundational cistern of claim 17, wherein a pilaster column is placed between two of the four corners of the base.

* * * * *